United States Patent [19]

Bors et al.

[11] Patent Number: 4,672,705

[45] Date of Patent: Jun. 16, 1987

[54] PROCESS FOR APPLYING CONTROLLED AMOUNTS OF LIQUIDS TO A RECEPTIVE MATERIAL WEB

[75] Inventors: Hans Bors, Fällanden; Peter Egger, Cham; Albert Götz, Oetwil a.d. Limmat; Martin Schwemmer, Urdorf, all of Switzerland

[73] Assignee: Triatex International AG, Switzerland

[21] Appl. No.: 657,900

[22] Filed: Oct. 5, 1984

[30] Foreign Application Priority Data

Oct. 7, 1983 [EP] European Pat. Off. ..... 83810466.9

[51] Int. Cl.[4] ..... D06B 1/14

[52] U.S. Cl. ..... 8/151; 118/246; 118/249

[58] Field of Search ..... 68/203, 202; 15/256.51; 118/246, 249; 8/151

[56] References Cited

U.S. PATENT DOCUMENTS

| | | | |
|---|---|---|---|
| 573,229 | 12/1896 | Metz | 68/202 |
| 1,033,266 | 7/1912 | Palmer | 118/246 |
| 2,323,907 | 7/1943 | Harriss et al. | 15/256.51 X |
| 2,329,034 | 9/1943 | Buck et al. | 118/246 X |
| 2,342,203 | 2/1944 | Kohler | 118/249 X |
| 2,977,662 | 4/1961 | Freeze et al. | 68/202 X |
| 3,104,182 | 9/1963 | Schneider et al. | 15/256.51 X |
| 3,499,419 | 3/1970 | Bohmer et al. | 118/249 X |
| 3,509,607 | 5/1970 | Fleissner | 26/101 X |
| 3,862,553 | 1/1975 | Schwemmer et al. | 68/202 X |
| 3,874,030 | 4/1975 | Knight | 26/101 X |
| 4,046,099 | 9/1977 | Komatsu | 68/203 X |
| 4,155,637 | 5/1979 | Witte et al. | 118/249 X |
| 4,180,317 | 12/1979 | Schroter | 118/249 X |
| 4,261,286 | 4/1981 | Kupfer | 118/246 X |
| 4,267,215 | 5/1981 | Riggs | 118/246 X |
| 4,322,026 | 3/1982 | Young, Jr. | 26/88 X |
| 4,455,845 | 6/1984 | Schiffer . | |

FOREIGN PATENT DOCUMENTS

| | | | |
|---|---|---|---|
| 2753580 | 6/1979 | Fed. Rep. of Germany | 68/202 |
| 2911166 | 10/1980 | Fed. Rep. of Germany . | |
| 1563335 | 4/1969 | France . | |
| 2023255 | 8/1970 | France . | |
| 2177572 | 11/1973 | France . | |
| 2311130 | 12/1976 | France . | |
| 535074 | 5/1973 | Switzerland . | |
| 530233 | 12/1973 | Switzerland . | |
| 392670 | 5/1933 | United Kingdom | 15/256.51 |
| 572062 | 9/1945 | United Kingdom | 15/256.51 |
| 992437 | 5/1969 | United Kingdom . | |
| 803990 | 2/1981 | U.S.S.R. | 118/246 |

*Primary Examiner*—Harvey C. Hornsby
*Assistant Examiner*—Frankie L. Stinson
*Attorney, Agent, or Firm*—Ostrolenk, Faber, Gerb & Soffen

[57] ABSTRACT

A method for the continuous and uniform application of controlled amounts of treating liquor on a liquid receptive material web comprising passing the web over a counter-roll having a resilient, non-skid surface and then passing the web onto an applicator roll with a metallic cylinder surface that has been dipped into a vat of treating liquor and making the treating liquor a uniform film on the roll. The treating liquor is tested before use by placing a quantity of the liquor in a mixing container, rotating the container for a first period and measuring the volume of treating liquor plus foam that develops in the container, and making two subsequent volume readings after further periods of time, adding all of the volume readings and comparing the sum with a standard value, and also determining that each volume reading is less than the preceding reading, and rejecting treating liquor which does not meet the foregoing requirements.

15 Claims, 11 Drawing Figures

FIG. 4
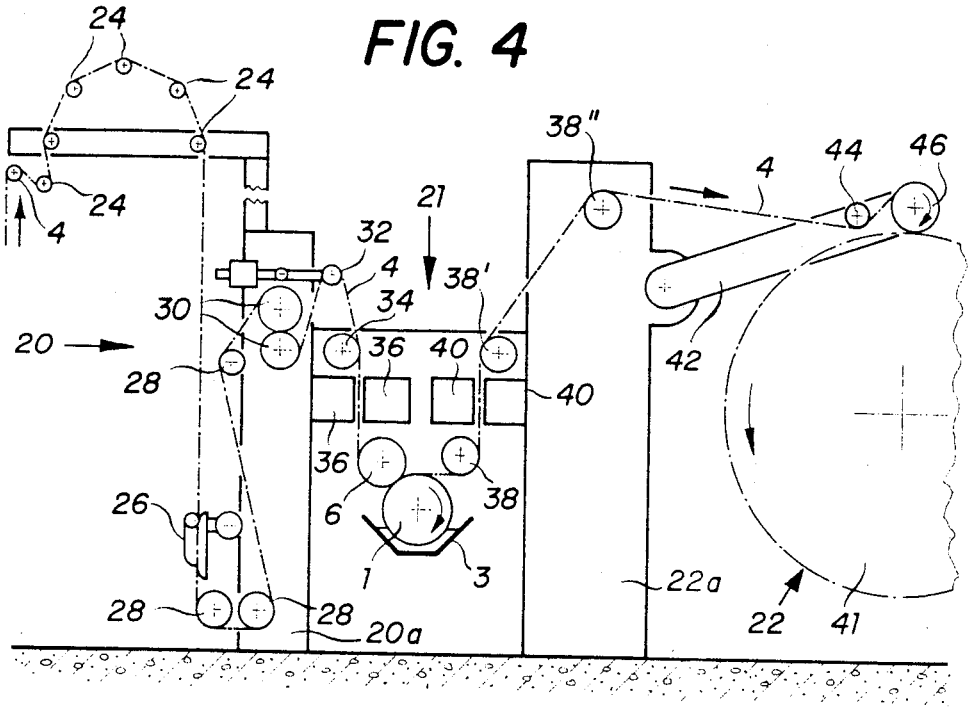
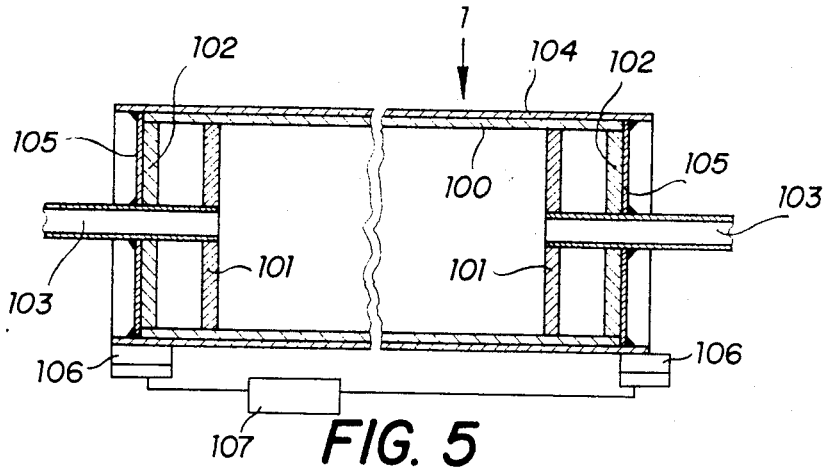
FIG. 5

PROCESS FOR APPLYING CONTROLLED AMOUNTS OF LIQUIDS TO A RECEPTIVE MATERIAL WEB

BACKGROUND AND SUMMARY OF THE INVENTION

This invention broadly belongs to the field of continuous or semi-continuous material web processing such as textile material or paper web processing in order to impart improved properties thereto. In its more specific aspects, the present invention comprises a new and useful apparatus and method to apply controlled amounts of treating liquor to a liquid receptive material web such as textile or paper webs. The apparatus of this invention has been designed and developped especially, but not exclusively, to improve the performing of the so-called M.A. process (i.e. minimum application process) basically disclosed in U.S. Pat. No. 3,811 834. The present invention further relates to new and useful liquors especially adapted to the method of this invention.

The M.A. process and the machines used for its realisation allow to perform a continuous application of relatively concentrated solutions, emulsions and dispersions of finishing or treatment agents which are evenly to be distributed in porous webs such as textile and paper, under rather high material speeds. In this process, the amounts of treating liquor used do no longer exceed the amounts strictly necessary to achieve the desired effects as it has been currently the case before, e.g. on the pad mangle. The M.A. process permits, compared with earlier technics such as the pad mangle, substantial energy savings or a highly improved effectiveness of the drier devices. Furthermore, cellulose crosslinking reagents surprisingly give an improved yield in that the same amounts of agents as used before, expressed as 100% active finishing agent per unit of area, yield better finishing effects; should these effects be quantitatively the same, a better abrasion resistance is achieved and the amounts of active agents are reduced by at least 10%.

The M.A. process distinguishes over the spraying and foam application processes promoted in the very last time as being particularly simple, also regarding the machines to be used, and in that a very uniform application and high working speed can be achieved. Foam application methods show serious technological problems regarding foam stability, foam composition and the control of the amount to be applied.

The M.A. process and the machines to be used are disclosed and explained in detail in above mentioned U.S. Pat. No. 3,811,834, in Swiss Pat. Nos. 530,233 and 533,074 and in Textilveredlung 10,1975, p.15-20.

The M.A. process is particularly suited for the continuous and homogeneous finishing of cellulosic textile webs, i.e. such which are composed exclusively or in the major part of cellulose fibers, by means of reactive finishing agents. The process has first of all been designed and developed for the application of curing resins with subsequent condensation on substantially dry textile webs. Of course, any other liquor or bath which contain substances capable of curing or of reacting with cellulose, may be applied continuously and evenly in the described manner During the use of the process for many years and the construction of the machines which can be used in the process, it has been found necessary to develop further this technical solution, in particular for special problems.

The M.A. machines allow the processing of smooth textile webs. However, should the starting textile material contain crumples and creases and still other wrinkles, e.g. staple wrinkles, the liquor application is slightly uneven. This unevenness normally does not create any problem in high performance finishing since they are invisible and affect only small portions. However, things change should the liquor contain visible components like optical brighteners or dyestuffs. The visible image is than impaired, and this negative aspect is enhanced by the unevenness of any high performance finishing which may be applied simultaneously.

One of the major objects of this invention is to solve this problem; the apparatus to be designed should be constructed such that any desired treating liquor application, be it a minimum application or not, can be effected on any liquid receptive web whatsoever in a continuous, controlled and even manner, and that unevennesses of the web do not result in corresponding unevenneeses in the liquor application. Such unevennesses are wrinkles, knots, sewings, pillings and so on.

Furthermore, it has been observed with the M.A. process that a starting textile web, particularly very lightweight fabrics, begin to flutter at very high process speeds, such resulting in unevennesses of the liquor application. It must however be noted that such speeds had originally never been contemplated and are situated well above 100 m/min. It is a further object of this invention to resolve this problem of fluttering too.

A further difficulty on a certain application of the M.A. process is encountered with knitted fabrics. Since the textile web is drawn in the M.A. process through the treating machine (this is the case with nearly all textile machines) and must be guided sliding over an application roll, the textile web generally travelling faster than the roll surface, a certain resistance in the form of a drawing tension is accumulated in the textile web, that tension being of the order of about 200 N when the web is 2 m wide. This tension will result on a knitted fabric in a curling of the web edges; the web being normally a lengthwise opened tube. But also flat knitted fabrics behave in the same manner. If the pulling tension is increased, the edges of the web show still more curling. There is a further object of this invention that knitted fabrics could be passed over the applicator roll in a flat and smooth state and only on the very low lengthwise and transverse tension. Models and suggestions to resolve these problems do not exist since furthermore it has been found, and this renders the problem still more serious, that knitted fabrics absorbe much more liquor than a woven fabric having a comparable rate per unit area.

The objects of the instant invention could only be approached and met by a combination of different means and measures which had to be found one after another independently from each other First, it should be noted that a kind of pad mangle as an applicator could not be contemplated since the pad mangle has only very limited control possibilities. A variation of the applicated amount can in practice only be obtained by means of the liquor concentration, and this is complicated and material and energy wasting.

The first approach to the objects of the invention was the introduction of a supported material condition. This condition can be defined with reference to FIG. 1: a steel roll 6, discharged by a counterweight 9 or by spring means (not shown), is arranged some degrees of an angle (angle $\beta$) in front of the normal contact line of a textile web 4 with an applicator roll 1, see the schematic illustration of FIG. 1. The applicator roll 1 rotates in the liquor 2 containing vat 3 and is coated with a hydrophilic rubber coating 1*a* indicated in dashed lines, this rubber being used to enhance the forming of a uniform liquor film on the surface of the applicator roll which will remain uniform until its absorption by the textile material. The textile web 4 is drawn around a deflection roll 5 and then over the applicator roll 1. The steel guide roll 6 which is journalled in an arm 7 pivotable around point 8, is resting with little force on the textile web 4. The counterweight 9 and its lever arm are so selected that the relief of the guide roll 6 is optimised. The contact line of the guide roll 6 with the applicator roll 1—these two rolls have parallel axes—is selected as to be situated by an angle $\beta$ of few degrees in front of the normal contact line 10 which would be the real contact line of the web 4' with the applicator roll 1 should the guide roll 6 not exist.

The expression "supported web condition" has been taken from the technic of mercerising where it is often used. It will express the fact that the web is not free travelling but supported on one side when it is transmitted to another machine element such as another roller.

This expression, however, does not mean that the material is opened to the arriving liquor since the tangential introduction of the web into the nip of two rolls does not open the web and is nevertheless a supported web condition.

The expression "applicator roll" means that this roll which is, in the contrary to the so called padding roll, not coupled with the material web sliding over it and to be supplied with liquor in the sense of the same speed of the travelling web and the roll surface. This will say that the applicator roll has generally a surface speed which is generally independent on the web speed and can be adjusted. The applicator roll may serve as the regulating element in a regulating or control circuit.

The installation described above could however not resolve the problems discussed above in a satisfactory manner, especially with regard to high processing speeds and the treatment of knitted fabrics. The partially balanced counter-roll causes occasional lift-off of the textile web on the entire width of the applicator roll so that the described solution could not be retained. However, this solution was successful for wrinkle containing textile webs where a uniform application of finishing liquors could be achieved and which was nearly impossible to obtain without the guide roll.

Then, it has been tried to mount the counter-roll with a fixed nip, considering that it should be possible to equalize wrinkels in the nip between applicator roll and counter-roll and to optimise spread-out of the textile web.

Corresponding experiments were however not successful since on one hand, a fixed counter-roll of steel amplifies in an unacceptable degree the frictional retarding effect on the material web which also must slide over the rubber surface of the applicator roll so that the drawing tensions in the material web became too high. On the other hand, the relatively hard rubber applicator roll is not fitted to absorb sewings in the supplied textile web which represent twice the material thickness.

Finally, the rubber applicator roll is easily damaged mechanically so that the liquor film is no longer uniform. The cleaning of the rubber applicator roll is particularly difficult due to its microporosity.

Now, in order to implement the objects of the invention mentioned above and still further other objects which will become more readily apparent as the description proceeds, it has been found that an applicator roll having a metallic surface, preferably with a certain defined surface quality, and a counter-roll having a resilient but skid resistant surface which is mounted in a constant but adjustable distance to the applicator roll and being parallel thereto, is used, that surface being capable to absorb uneven portions of said web. This combination of features is surprising since the wettability of metals by the aqueous liquors of the material finishing or treatment is generally insatisfactory.

Basically, it is not too difficult to produce a continuous and uniform water film on a metal surface; this is for example achieved by the cleaning of the matal and the addition of a tenside to the water. However, in the present case, the treating liquors are given ones and contain normally components which counteract to the forming of the film but which cannot be foregone. Furthermore, the liquor composition can only be modified with a great precaution since the liquor is optimised in view of the desired finishing effects. The free addition of high efficient tensides particularly impossible since these tensides, although they improve the forming of the film, act generally as strong foam formers and would therefore render impossible the production of thin, uniform and bubble free films on the applicator roll.

A further object of the present invention is now implemented by a new class of treatment liquors in that a special film forming test has been developed to screen liquors which are capable of forming a continuous and uniform film on a metal surface. The aqueous liquors typically contain special tensides; they are characterized by the fact that they fulfill the film forming test to be described later. The invention is seen in the combination of certain properties of the liquor with the use of an applicator roll having a metal surface; treating liquors known per se may be used as far as they fulfill film forming test.

The applicator roll consists at least on its surface of such a metal which requires a very smooth surface structure in the process by the polishing action of the material web. A preferred material is stainless steel; for example the roll surface has been smoothed to a roughness grade N5 according to VSM 10230/31.

The counter-roll must be arranged thus that the material web first contacts the liquor film in the roll nip or shortly before, i.e. that the web is opened to the liquor and is simultaneously in supported condition, i.e. it is supported from behind by the counter-roll.

It has now surprisingly be found that the nip of the counter-roll and the applicator roll can be adjusted to a thickness which is less than the mean thickness of the material web. This is probably due to the resilience, normally the rubber elasticity, of the counter-roll. It could not have been foreseen that the material web would not acquire unacceptable tensions and distorsions under these conditions, its speed being typically higher than that of the applicator roll. Even a destruction of the web would have to be considered.

In fact, the thickness of the nips can be adjusted in the limits defined below, and the retaining force in the material web can be adjusted.

The thickness of the roll nip is less than the mean thickness of the material web. This will say that the counter-roll is slightly flattened in the nip, at least if the web is not sufficiently compressible. The thickness of the roll nip is preferable 60 to 80% of the mean thickness of the material web. This mean thickness is measured according to SNV 98411 (this corresponds to DIN 53855 and ASTM D 1777-64). The counter-roll has a resilient surface. Preferably, this surface comprises a thick coating of nitrile rubber having a Shore hardness of about 35. Still softer qualities can be used.

The counter-roll may also be a brush roll having very closely set brushes, a sponge rubber or plastic sponge roll, a felt roll, a velvet roll, a step roll, a suction roll etc. It is important that the surface is non-skidding for the material web.

The adjustment of the fixed distance of the counter-roll to the applicator roll can be made by hand or by electro-mechanical, hydraulic or pneumatic means. It is preferred to display simultaneously the value of the nip thickness. Since the thickness of the material web may vary when the material web proceeds, an automatic adjustment of the roll nip is appropriate. This can easily be managed since the weight per unit area of the web is particularly measured before the application of treatment liquor; the corresponding measuring device is generally combined with a thickness measuring apparatus, or one might calculate the function of the thickness dependent upon the rate per unit area, and this function is used. And said value for the thickness of the roll-nip is then introduced (for example 75% of the average material web thickness) which will then be kept constant by control devices known per se.

At least two doctor blades are preferably attached to the applicator roll. The first blade is situated at the surface region between the take-off line of the web and the dipping line of the roll into the liquor and serves to remove dirt, particles and film residues optionally present. The removed material is discarded or recycled after cleaning processing. The second doctor blade is arranged below the liquor level in the liquor vat and serves to remove residual film bubbles and for controlling the current of the liquor around the applicator roll surface.

Since the counter-roll it has no resilient support, a guide-roller 5 which had first been provided, see FIG. 1 is no longer necessary. The counter-roll can be free running or may be driven. When a thin and light material web or knitted fabrics are processed or high travelling speeds are used, the counter-roll should be positively driven.

Without being bound by any theory, the inventors suppose that the following phases are encountered on carrying out the process, and these phases are schematically illustrated in FIG. 3*a* to 3*c*:

1. Phase I (FIG. 3*a*)

The porous web 4 passes over the rubber counter-roll 6, is transformed into the convex configuration and opened to the liquor film F coming from the application roll 1. In the moment of the contact, the liquor film F can better enter into the open hollow spaces H of the web. Due to the high speeds and the speed difference between applicator roll and material web already mentioned, the film is distributed into droplets, and the absorption of the liquor is enhanced.

2. Phase II (FIG. 3*b*)

The liquor containing web 4 is compressed in the nip of the rolls 1 and 6 under elastic deformation of the counter-roll 6 as well as of the web 4. The preceding material opening is abolished, and the web is transformed into a weakly concave configuration. This fulfill all mechanical and physical conditions for an even distribution of the liquor in the material web. The absorbed liquor is brought in close contact with the material structure by the pression on the material. Furthermore, the web is slightly opened to its backside thus creating a suction effect on the liquor.

These actions are favoured by the use of substantially foam free liquors which do not introduce an air pad into the material web.

3. Phase III (FIG. 3*c*)

In this third phase wherein the web 4 is still in contact with the applicator roll, the take-up and the distribution of the liquor are completed as far as necessary since the compression of the web has been cancelled. This further contact can be expressed as an angle at centre (e.g. $\alpha_1$, FIG. 2) of the application roll, as a length (distance on periphery, or as a dwell time. A dwell time expression is preferred since the distribution of the liquor is a function of time. The contact angle is selected to about 2° to 15° corresponding to a length of about 6 to 40 cm on the roll surface and a dwell time of about 0.02 to 0.2 sec. When low material speeds are used, the liquor has sufficient time to pass completely from the applicator 1 into the web 4, and the web can directly be taken-off from the applicator roll in (arrow I in FIG. 3*c*). The value of the contact angle may be used to further control the retaining force in the web.

The take up of the liquor by the material web depends upon the proportion of the affinity of the liquor to the material web 4 and to the surface of the applicator roll 1. The normally remaining film boundary layer of the liquor is reduced when the web travels faster than the surface of the applicator roll 1, and this case is preferred in this invention. Due to this relative mouvement between web and the applicator, the latter is continuously cleaned and smoothened.

A special problem is the application of treating liquor to knitted fabrics in the M.A. process. It is known that problems exist in passing this textile product through treatment machines due to its special open structure. A drawing tension in lengthwise direction leads to a shrinking of the web in transverse direction. The web edges have a very strong tendency to curl, and curling angles of more than 360° can be observed particularly on opened knitted tubes.

This invention renders possible the treatment in the described apparatus even on high process speeds when the web of knitted fabrics is struck even on the counter-roll by a gaseous flow, especially airflow, coming from appropriately shaped air nozzles. The material web is preferably first passed over a lath roller for centering and spreadening of the web, especially before reaching the first weight measuring device; between this device and the counter-roll, the web passes a novel flat air spreadening apparatus. Other preferred devices will be described later.

The use of a metal applicator roll, for example of steel, which has been developed in this invention opens new and useful possibilities to improve the process. Such rolls are typically constructed as hollow rolls to save weight, and the use of a hollow shaft allows to thermostate the roll by passing a corresponding heated or cooled flow medium, thus allowing to exactly control the film quality, the liquor concentration and other liquor properties including evaporation speed. This has not yet been possible with the applicator roll used until now which has a thick rubber surface layer and therefore bad thermic properties. Only the use of a metal roll having a very smooth and pore free surface as an applicator roll by this invention allows for the first time a compression of the material web since the surface friction of the web is still acceptable at the preferred speed differences between web and roll surface. Finally, such a roll can easily been cleaned and kept clean.

The invention further concerns a process for applying of a treating agent to a liquid receptive material web and furthermore a treating bath.

The process of this invention is not limited to the application of reactive finishing agents to cellulose containing textile materials. It can also be used to apply any liquor whatsoever, also non-aqueous ones, of any composition to any liquid receptive and flexible web materials whatsoever, and this application can be used to achieve a homogenous distribution or a one-side treatment. The material of the web needs not to be hydrophilic but must be liquid receptive. The liquors need only fulfill the film test described below and should generally pass the foam forming test also defined below.

Liquid receptive and flexible materials in web form are firstly textile webs, namely fabrics, knitted fabrics and non-wovens of known textile fibres, for example native and regenerated cellulose, wool, man-made fibres like polyester, polyolefine, polyacryl, polyvinylchloride, polyamide, glass, asbestos and other mineral fibres like stone and slag wool. Furthermore, natural and synthetic paper and thin cardboard can be used. Sheets formed by a plurality of parallel yarns, for example warp yarns, which are in mutual lateral contact and may also form two and more layers, can also be treated. The material may also be damp but not so wet that the liquor is squeezed out in the roll nip.

The application of the liquor leads generally to a homogeneous distribution thereof within the web material. Under normal conditions for which the M.A. process has originally been developed, a liquor applied to one side of the web forms therein a liquor distribution which is even throughout the substrate. However, the present invention is not limited to this effect.

Further, very interesting possibility for the use of the new apparatus is the wet-in-wet technic or the controlled addition application. This method allows to save one drying step. It uses as a starting material a web which still is damp, for example a web coming after the dyeing step from a pad mangle, and this web is impregnated in the apparatus of the invention with minor but controlled amounts of another liquor. It is possible to apply a pre-determinated, constant amount of liquor, e.g. 10 g/m2 or 20 g/m2 or, alternatively, the "missing" until predeterminated value of total liquor, namely dyeing liquor plus second liquor, is completed.

This method may usefully be applied for dyeings, for example reactive dyeings, where the dyestuffs and the fixation agents are applied successively or where different dyeing liquors are successively to be supplied. But also for other combinations, for instance dyeing and hydrophobic finishing, this addition application may advantageously be used.

Sometimes a migration of applied substances in the web material is desired, e.g. dispersion dyes in polyester fabrics. In these cases, such amounts of liquor are applied by means of the apparatus of the invention that during subsequent drying, the optimum value of migration will be obtained and as s result one obtains fabrics which are particularly level dyed in very unexpensive manner. This method is termed by the applicants as a "controlled addition application".

Substantial advantages of the new apparatus and of the process, particularly in contrast to pad mangles and pad mangling, are first a better control possibility of the applicated liquor—such a control is virtually absent in pad mangles—, the constance of the applicated amounts in transverse direction of the web due to the absence of sagging rolls and the absence of variations in the liquor.

In some cases it will be desirable to modify the described technics, processes and methods and to wish to have an uneven application, for exemple should the web material undergo a crepe formation or an effect dyeing. This effect can be achieved according to this invention by disturbing the film conducted by the applicator roller. The distortion of the film should be a random one, i.e. without noticeable uniformity. This can be performed by means of a toothed doctor blade which is moved horizontally to and fro on the liquor film of the applicator roll with a randomly changing speed or driven by corresponding pulses, by means of an irregular blowing on the film and so on.

DESCRIPTION OF PREFERRED EMBODIMENTS

Figure 1:
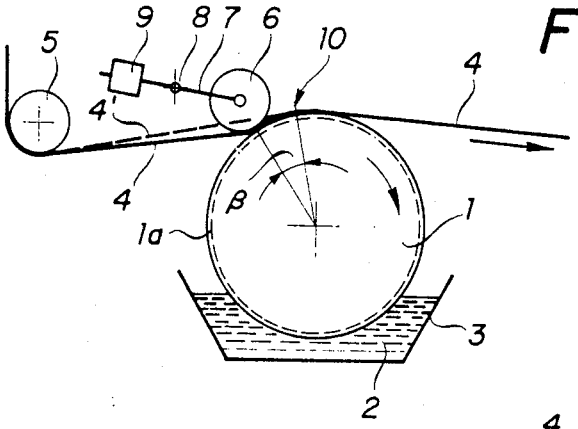
Figure 2:
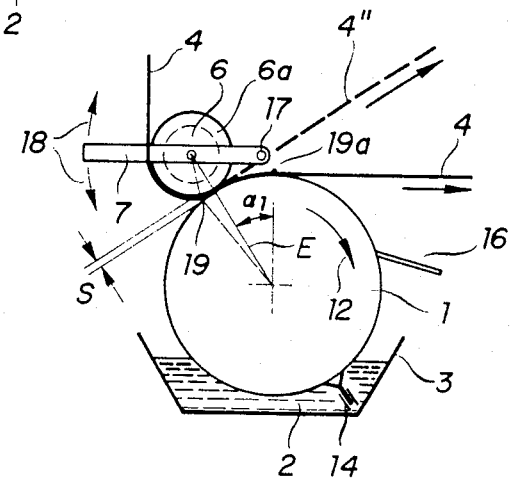
Figure 3A:
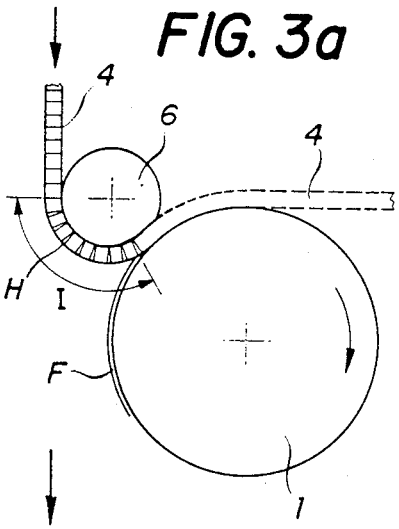
Figure 3B:
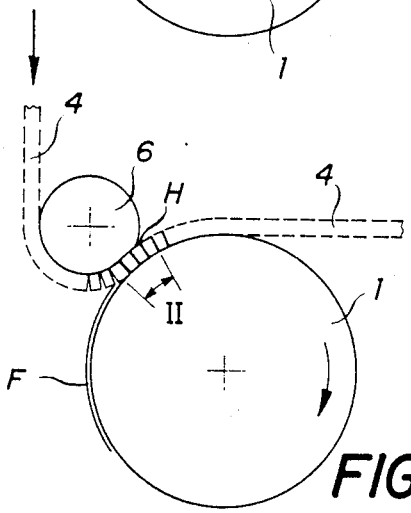
Figure 3C:
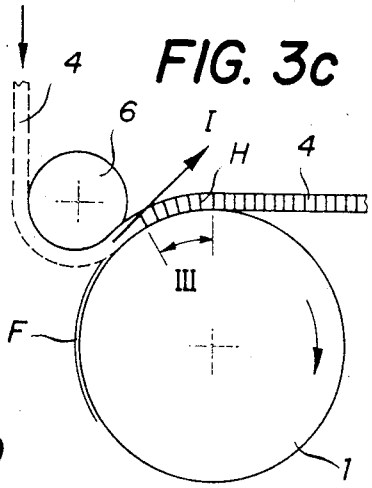
Figure 8:
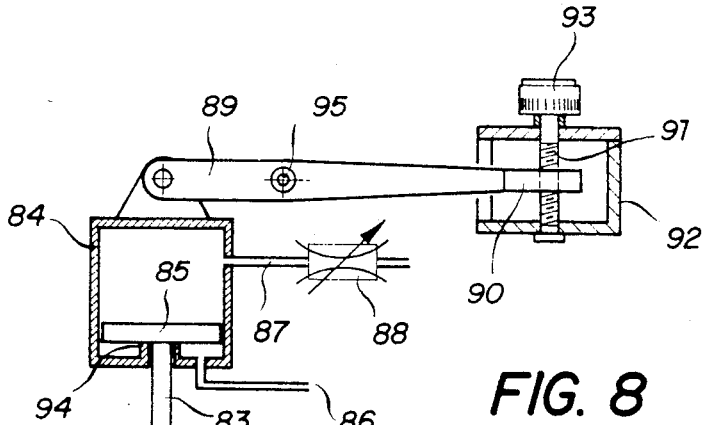
Figure 9:
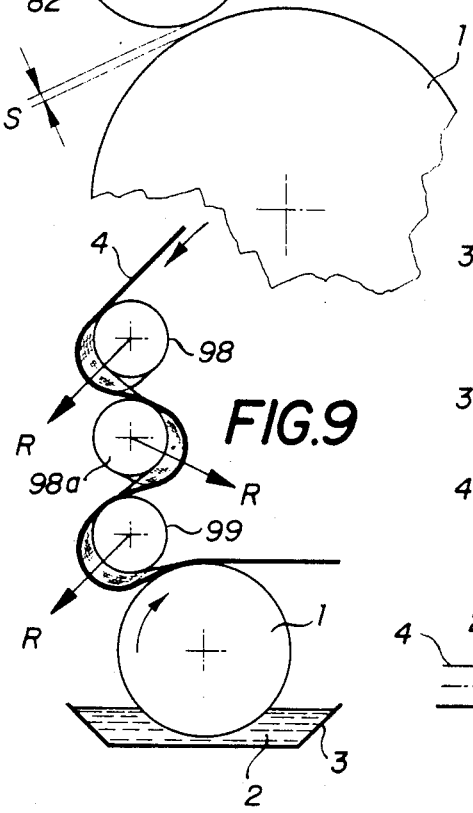
Figure 6:
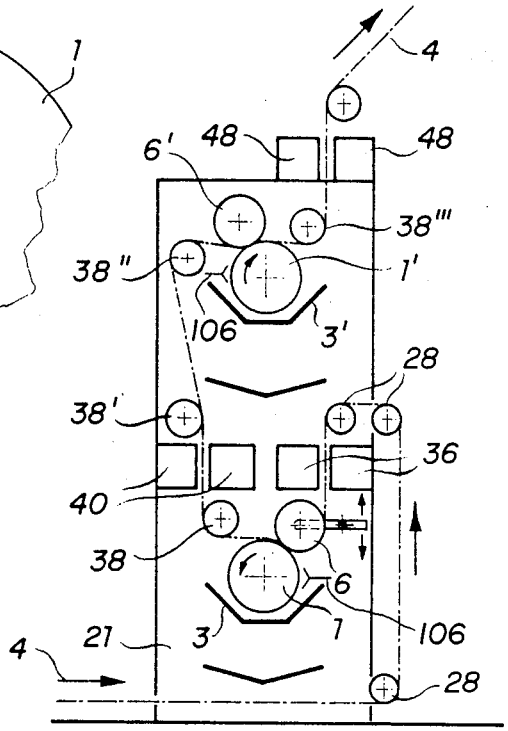
Figure 7:
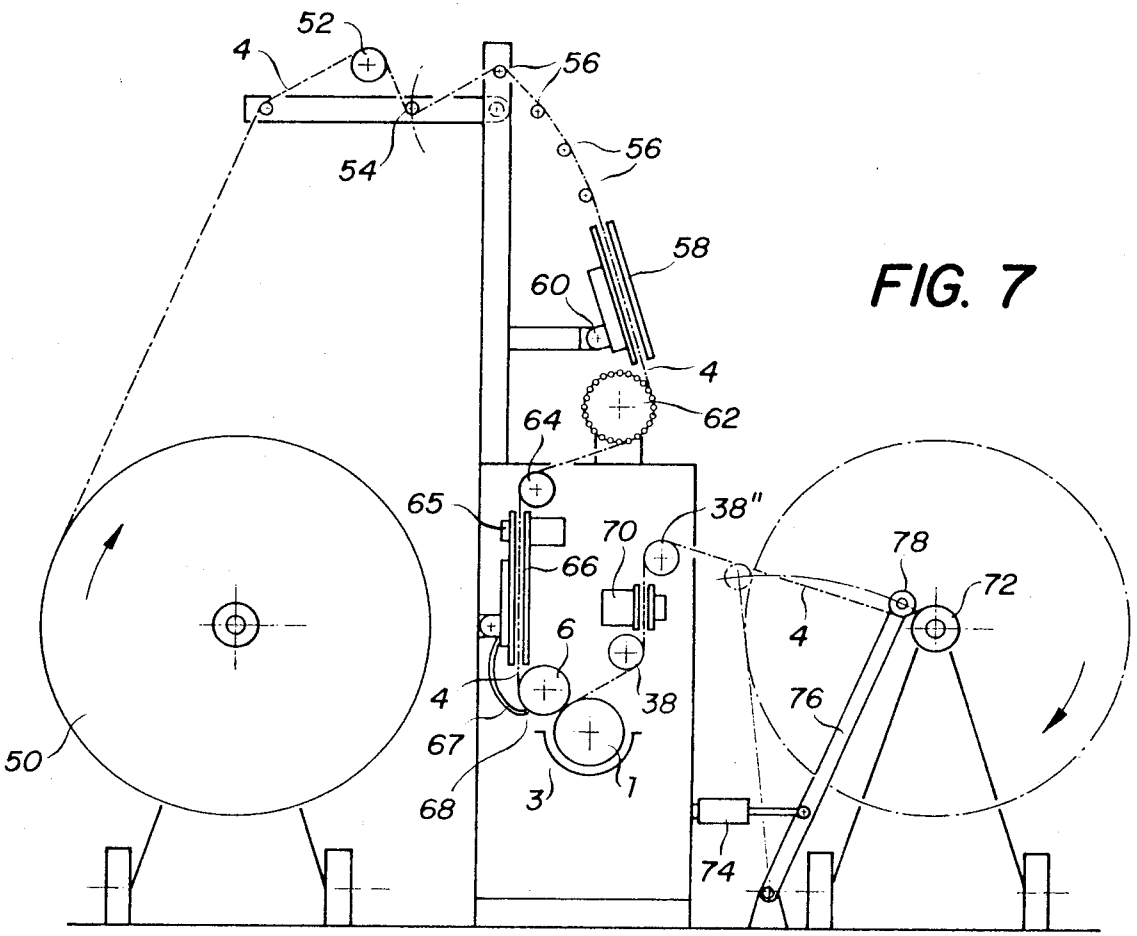

Some preferred embodiments of the apparatuses according to the present invention are now be described as examples with reference to the drawing. This description should not be construed to limit the instant invention. At the same time, the application process will be explained on embodiments as examples. In the drawing:

FIG. 1 is a schematical sectional elevation of the applicator device which has been used for first experiments, FIG. 2 shows in sectional elevation an applicator device of the invention in one working position, FIG. 3*a* to 3*c* show three phases of the liquor application according to this invention, FIG. 4 represents the most important parts of the complete apparatus of the invention, schematically in sectional elevation, FIG. 5 is a lengthwise section of the used applicator roll, FIG. 6 shows in an analoguous manner as FIG. 4, the middle region of a device for a double application of treating liquor, FIG. 7 illustrates an apparatus for the application of treating liquor to knitted fabrics, FIG. 8 schematically shows the mounting of the counter-roll, and FIG. 9 is a schematical illustration of an embodiment with curved rolls.

Identical or equivalent parts in the drawing are designed by the same reference numerals.

In an embodiment of the process of this invention, the webs are fed to several drying apparatuses. Since the amounts of liquor introduced into the web material are very small and fill substantially only the micropores of the substrates, there is no danger that the wound up materials would form liquor accumulations in the lower parts of the windings as this can be observed with pad mangled materials. Therefore, this invention permits an intermediate winding up and a subsequent drying in appropriate driers should the current drier capacity be exceeded. In addition the apparatus of this invention is already capable of processing the materials with speeds of 170 m/min and more and the driers may not always follow this speed in spite of the small water amounts to be vaporized. Normally, the apparatus should therefore work for at least two drier installations.

The test device of FIG. 1 has already been discussed above and should therefore not be repeated here.

FIG. 2 shows the principal realization of the application apparatus in the new machine. The applicator roll 1 rotates in the vat 3 containing the treating liquor 2. The roller 1 is made of steel (see below in context with FIG. 5); a film removing doctor blade 14 is pressed to the roller 1 beneath the liquor level and this doctor blade may additionally serve for smoothening of the flow in the vat. It frees the applicator roll from air bubbles which could adhere to its surface when it dips into the liquor.

In order to avoid a damaging of the applicator roll and to remove the air bubbles without distortion of the liquor flow, a new doctor blade construction has been developed. This blade is made of a rubber or plastic strip having a Y-shaped section whose arms are thickened at their ends and whose vertical leg or stem is fixed in metal rail. The blade is now approached to the roll until the arms of the Y come in contact therewith and spread out. Thus, the doctor blade functions effectively and reliably, and.avoids any damage of the roll.

A second doctor blade 16 on the same side of the applicator roll, but above the liquor level, removes any remaining liquor residues and dirt particles from the atmosphere or the treated substrate. Any excess liquor can be cleaned and recycled into the vat.

Should the material web be narrower than the applicator roll which is nearly always the case, it is preferred to provide on each border of the material web a lateral doctor blade (shown in FIG. 5) which keeps the free margins of the applicator roll free from liquor. It is preferred to arrange these blades with an automatical lateral following control which may be realized by optical sensors and co-operating servo-mechanisms (not shown) so that these blades will follow the lateral displacements of the material web.

The counter-roll 6 having the already described soft rubber coating 6*a* (about 35 Shore) or which is entirely of soft rubber is journalled in the rocker-arm 7 being pivotable about the axis 17. The nip S between the applicator roll and the counter-roll can be varied and adjusted by adjustment means symbolized by arrow 18.

The incoming material web 4 goes first around the counter-roll 6 and first contacts the liquor film on the applicator roll at the generating line 19 which is situated, seen in travelling direction of the web, in front of the plane E which goes through the axes of both rolls 1 and 6. The web leaves the surface of the applicator roll in the generating line 19*a*. The distance between both generating lines 19 and 19*a* represents the wrapping of the applicator roll; this distance is about 6 to 40 cm corresponding to an angle $\alpha_1$ of from 2° to 15° depending upon the roller diameter; the dwell time should be from 0.02 to 0.2 sec, generally about 0.1 sec. This distance is generally determined by the admissible retaining of the material web by surface friction on the applicator roll 1. This roll 1 is rigidly driven, i.e. it is also retained if necessary and therefore rotates with a constant but controllable speed, and typically with a smaller surface speed $v_0$ than the advancing speed $v_T$ of the material web. These two speeds have a ratio being in the range of about 1:10 until about 1:0,5 and typically amounts to about 1:2. The value of v is generally about 20 to 200 m/min depending upon the nature of the web. The angle $\alpha_1$ also depends, as already mentioned, upon the absolute value of $v_T$.

The web 4 wraps the counter-roll 6 on a portion of its periphery corresponding to an angle at centre of from 60° to 120°. The web 4 comes from above at is shown in FIG. 2 and in this figure the said angle is about 100°.

On its rotation, the applicator roll 1 is first freed from residues by the doctor blade 16 and is than dipping into the liquor 2 in a clean condition. The underlevel doctor blade 14 removes attached bubbles. The roller surface emerging from the liquor 2 carries a uniform liquor film whose thickness depends upon the roll speed, the composition of the liquor and its viscosity and surface tension (which are temperature dependent). The plane of the doctor blade 16 is directed against the rotating direction of roller 1.

In order to modify and to adjust the retaining force which is created in the material web on the applicator roll and which will result in a variation of the pulling tension in the web, several possibilities can be used. A first possibility is the taking-off of the web with a positive angle to the horizontal plane (e.g. web 4 in FIG. 2), i.e. in decreasing the angle $\alpha_1$ if necessary until nearly the zero. However, there is a certain danger of an incomplete take-off of the film from the applicator roll as it has already been mentioned. A further possibility is the partial removal of the counter-roll from the applicator roll in order to increase the thickness on the nip S within allowable limits; this possibility is presently preferred due to its technically simplier realization and its better capability for automatization. It must be noted that the roll nip S should generally not be more than about 80% of the average material thickness of the web since otherwise the supported condition of the material at its first touch with the liquor film is no longer guaranteed. The adjustment of the nip S may be effected by technical means known per se not shown here, e.g. by an eccentric device whose handling knob is preferably equipped with a scale where the thickness of the nip can immediately be read.

FIG. 3*a* to 3*c* have already been explained.

FIG. 4 is schematical side view of a substantially complete apparatus constructed according to this invention.

This machine has three main portions, namely the delivery portion 20, the application portion 21 and the winding-up portion 22.

The web material, for example a textile fabric, is unwound from the supply roll (not shown). This material 4 travels in the direction of the arrow first between or over several equilibration rolls 24 arranged in a semicircle intended to equalize any internal material tensions, to spread the web and to smoothen impressed creases. The web travels downwardly within the frame 20*a* of the delivery portion 20 and passes then the web guidance and centration device 26, which can be displaced laterally and wherein the material web is constantly adjusted laterally in such a manner that its edge finally touches always the same circumferential line of the applicator roll. The control may be effected in a manner known per se in that the web is monitored by sensors (not shown), e.g. light barriers, and the variance signal is transmitted to the adjustment control (not shown) of the device 26. The guidance device is a known part and is commercialized for example by the company Erhardt & Leimer KG in Augsburg (Federal Germany).

After having passed the guide rollers 28, the material web enters the roll nip of the delivery device 30, which ascertains together with the winding up device to be described later, a constant pulling tension in the web during the liquor application. The controlling element of the control loop is the balanced sensor roll 32 over which the web 4 is passed after having left the delivery device 30. It further contacts a guide roll 34 and goes then through the free space between the emitter and the receiver of the contactless web weight measuring unit 36. Such units are already known for a while and need therefore not be described in details. They function on the basis of radiation absorption. In the measuring unit 36, the weight per unit area of the untreated material web is determined. The material web 4 is now passed to the counter-roll 6 which has already been described in details. Therefore, FIG. 4 does not show details thereof.

The material web which has received the liquor film offered by the applicator roll 1 and has absorbed it, is now deflected by the first deflector roll 38 vertically upward and is further deflected by two other deflector rolls 38', 38" towards the winding up unit 22. During its travelling upwardly, the material web which contains treating liquid traverses the second web measuring unit 40 which functions identically to the first unit 36 and which produces together with the latter a quotient or difference signal which serves in a manner known per se to control the applicated liquor amount; these devices do not belong to the invention, and reference is made to the German Offenlegungsschrift No. 2.114.517, page 16. Generally the rotation speed of the applicator roll is adjusted in order to control the applicated amounts.

The winding up unit 22 consists first of the roll 41 of material web which is winding up and a guide arm 42 attached to the machine frame 22*a*, acting upon the roll 41 in formation. In the guide arm 42 which is present twice, there are a deflection roll 44 and a depositing roll 46 which is driven by a coiling motor (not shown) with constant and adjustable speed. The material web 4 wraps the roll 46 by at least 180° and forms by depositing the winding 41. As the diameter of this winding increases the pair of arms 42 moves upwardly. This described arrangement has the advantage of keeping constant the drawing tension in the material web 4 and the formation of very uniform winding 41.

Completed windings41 are removed and sent to the drier. The windings are changed by automatic winding changers known to the man skilled in the art. They are not shown and their description may be forgone.

The described winding up of the damp material web containing treating liquor has the advantage that the subsequent drying may be effected under any appropriate speed in the drier or the tenter frame; should the drier have a break-down stop, the liquor application which is independent can be continued and vice-versa.

FIG. 5 shows a cross section in lengthwise direction of a preferred applicator roll 1. This roll has first an inner hollow cylinder 100 which is connected at its both ending regions by two pairs of annular flanges 101, 102 with hollow axle stubs. This inner cylinder 100 carries the outer cylinder 104 of special steel which is fixed on the inner cylinder by heath shrinking and has a wall thickness of about 3 to 5 mm. On its frontal regions the outer cylinder 104 is connected to the axle stub by means of welded covering flanges 105 touching from the outside each outer annular flange 102. The lateral surface of the outer cylinder 104 is grind finished to a finish N5 according to Swiss Standard VSM 10230/31. As it can be seen in FIG. 5, the outer cylinder 104 goes on those sides beyond the inner cylinder 100 and the covering flanges 105, for example at about 12 to 15 mm each. This measure avoids that liquor creeps from the vat over the flanges 105 to the lateral cylinder area or is ejected from the frontal cylinder faces or forms liquor swellings there. Therefore this construction is preferred by the invention.

Heating or cooling fluid may be introduced and evacuated through the hollow axles 103. It is also possible to heat the roll electrically or by gaz from the interior. The same applies to the liquor in the vat, e.g. the vat or the inlet or circulating lines of the liquor, intermediate vessels etc. may be used as energy transmitters in controlling or maintaining constant the liquor temperature.

Two lateral doctor blades 106 are applied against the edges of the cylindnrical surface of the applicator roll 1. These doctor blades 106 are the same construction as doctor blade 14 described above with reference to FIG. 2. The circumferential or angular location of doctor blades 106 is shown in FIG. 6 as an example. This location may also be elected for all other embodiments of the apparatus. A shifting mechansim 107 mechanically connected to the doct blades 106 is also schematically shown in FIG. 5. This shifting mechanism 107 will shift the doctor blades 106 laterally when the web 4 to be treated departs laterally during its travel. The construction, mounting and running of the device 107 is one which is well-known to those skilled in the art.

Typical dimensions of these applicator rolls 1 are 100 to 300 mm and nearly any desired length.

FIG. 6 schematically shows a sectional elevation of an apparatus for the application of treatment liquor on both sides of a web wherein these liquors may be identical or different; only the applicator unit is shown (see FIG. 4).

The machine has a frame 21 and therein two applicator devices. The material web 4 enters from below into the machine and is deflected three times by three rollers 28. These rollers 28 may be free running or positively driven. The material passes the first contact free measuring unit 36 which determines the weight per unit area of the dry, untreated material. Now follows the first applicator unit comprising the liquor vat 3, the applicator roll 1, the counter-roll 6 and the deflector roll 38, and this unit is an identical mirror image of the corresponding unit in FIG. 4; the detailed description should therefore not be repeated here. The web now traverses the second contact free measuring unit 40; the quotient signal of the units 40 and 36 is a measure for the applied amount of liquor. The material web is now passed over to further deflector rollers 38' and 38" to the second applicator unit which, as it is evident, acts onto the other side of the material web and comprises again a liquor vat 3', an applicator roll 1', a counter-roll 6' and a deflector roll 38'''. The web 4 being now treated on both sides leaves the machine upwardly and may then be deflected and wound up as desired. It first passes the second contact free weight per unit area measuring device 48:by forming a quotient of the values with that of the measuring unit 40 and/or 36, the second or the whole amount of applied liquor may be determined, The produced signals serve in a manner known per se to control the drive of rolls 1 and 1' in order to adjust the applied amounts A very interesting application of the apparatus of the present invention in applying successively two different liquors is the dyeing of a fabric made from cellulosic fibres with reactive dyes according to the dwell-padding process. In this process a solution or dispersion containing the active dyestuff and optionally normal additives like urea and tensides but devoid of alkali or capped alkali, may for example be applied in a first step with an amount of 30 to 50%, calculated on the weight per unit area of the dry fabric. The alkali free application of controlled amounts according to the invention guarantees stable treating liquors and results in a constant application amount even with very substantive systems, without unevennesses on the edges or in the terminal portions. In the second applicator unit the alkali necessary or the fixation of the dyestuff is then applied without any intermediate drying of the web, optionally together with salts and tensides, and the amount of this liquor will be typically 15 to 30% of the weight area of the dry fabric. Adjustment of the alkali concentration may be made without any respect to the stability of the dyeing liquor in such a manner that there is the best fixation of the dyestuff. Since the total amount of liquor applied by the two applicator devices remains below the values of the conventional pad mangle application of alkali containing liquor, there are favourable conditions for best dyestuff fixation. Furthermore, dyestuff consumption is reduced in most cases. The dwell step and the following washing step are effected in a known manner.

EXAMPLE 1

| | |
|---|---|
| Fabric: | cotton popeline, 110 g/m2, normal pre-treatments, bleached and mercerized. |
| Liquor 1: | 35 g/l "Remazol" blue 3R (Hoechst)<br>2 g/l "Leophen" LG (BASF)<br>80 g/l of urea |
| Application: | 40%, based on dry fabric weight |
| Liquor 2: | 30 g/l of sodium hydroxide<br>80 g/l sodium sulfate<br>2 g/l of "Leophen" LG |
| Application: | 20% based on dry fabric weight |

The fabric is wound up following the liquor applications as already described, and covered by plastic sheet, is left in a known manner during 16 hours at room temperature and may afterwards be rinsed, acidified, soaped, rinsed anew and dried.

As a result a dyeing is obtained which is extremely even over the width and length of the web.

FIG. 7 shows in sectional elevation schematically a machine for applying liquor to very delicate and sensitive materials such as tissue, paper and, especially, knit fabric. This material shows a durable curling of the web edges. Furthermore, the drawing tensions in lengthwise direction result in a transversal shrinking, and unequal forces result in diagonal distortions.

The material to be treated is wound up on the supply roll 50 equipped with a delivery driving mechanism at centre (not shown). The web 4 is passed over a driven deflection roller 52, under a jockey roller 54 and some guide rollers 56 in a flat spreading device 58; the guide rollers 56 are arranged in an arcuate path. The jockey roller 54 produces in a manner which is known to the man skilled in the art a signal to control the delivery motor (not shown) on the roll 50. The air spreader 58 acts by directed air jets on both sides on the knit fabric web 4 in such a manner that it leaves the spreading device 58 in an even, smooth and wrinkle free condition and only little curls in the edges. This spreading device may be adjusted on its pivotable support 60 as to its angle with the web 4. The knit fabric web is now passed on the lath roll 62 which is driven and whereon the material web is further centred and better spread. The lath roll 62 and the air spreading device 58 are known and commercialized products of the company Erhardt & Leimer KG, Augsburg, Federal Germany. The man skilled in the art is familiar with construction and the function of these machine elements.

The web now centred passes on a free running guide roller 64 in a device 65 for the contactless measuring of the weight per unit area and then through a second air spreading device 66 which is constructed like the first spreading device 58 on the counter-roll 6 which is positively driven. It has been observed that the material web still presents a residual tendency of curling in the edges. In order to remove this residual tendency, the invention provides special edge decurling nozzles 68 which are fixed at the end of air ducts 67 which act on both marginal regions of the web in blowing air jets thereon, namely shortly before the entry of the web into the nip S, and it has been found that this mode of acting the material web acquires when touching the applicator roll 1. a completely even contact thereon. The vat is referenced by number 3. After the application of the liquor on the material web it is passed by the second device 70 to contactless measure the weight per unit area and is then wound up. The necessary deflector rollers 38 and 38" are also positively driven.

The winding up of the damp impregnated knit fabric is preferably effected by the principle of supported material condition. The winding-up reel 72 is fitted with a driving device at centre (not shown) which is controlled by the output signal of a suitable control device (not shown). A counter-roll 78 is pressed against this reel 72 by means of a hydraulic or pneumatic motor 74 and a lever arm 76, and the counter-roll 78 maintains the web 4 in supported condition at the moment of its winding up.

It has been found that the described special measures and apparatuses allow to effect a uniform liquor application, e.g. minimum application, even on most delicate material especially knit fabric, under high process speeds, namely up to 200 m/min, what has until now been considered as absolutely impossible.

The represented machines may be equipped additionally with cord rolls, known per se, to smoothen the web and to spread out wrinkles.

FIG. 8 schematically shows the most preferred mounting of the counter-roll 6. This mounting allows a precise and everywhere identical adjustment of the roll nip S as well as a quick removal of the counter-roll with parallel motion, for example when there is a large thickening in the web coming to the rolls. This quick removal can avoid a rupture in the web.

This mounting of the counter-roller 6 first comprises the bearing block 80 wherein the shaft 82 of the roll 6 is journalled and which can be vertically displaced between two guide blocks 81. This displacement is guided by piston rod 83 being connected to a piston 85 movable within a cylinder 84. A duct 86 ends in the cylinder 84 below and another duct 87 above the piston 85. A throttle valve 88 may be inserted into the duct 87 which is capable of slowing down the fluid.

The cylinder 84 is journalled to a double armed lever 89 whose other end 90 has an internally threaded bore hole. A threaded spindle 91 goes through the bore hole and carries at the outside of the bearing housing 92 a scale wheel 93. The threaded spindle 91 may be connected to a servo motor (not shown).

During the use of this device the duct 86 is not under pressure, and there is a pneumatic or hydraulic pressure in the duct 87. The piston 85 is therefore pressed against the inner projection 94 of the lower cylinder front plate. The exact thickness of the roll nip S is now adjusted by corresponding turns of the scaled adjustment knob 93 and remains constant.

The pressure within the cylinder 84 acts like a spring; the roll 6 may therefore deviate upwardly when necessary before there is a rupture of the material web. Should it be necessary to make a quick relief of the roll 6 from the applicator roll 1, pressure is given on the duct 86 and the duct 87 is relieved, and therefore the piston 85 and the roll 6 are immediately pushed upwardly but in a mouvement which is cushioned by the throttle 88. When the piston is then lowered, the previously determined and adjusted value S for the thickness of the nip is automatically readjusted by the device.

FIG. 9 schematically shows a further preferred embodiment of the apparatus according to the invention which is particularly well fitted for the use with numerous crimps containing material and with permanent wrinkles.

The material web 4 is passed substantially from above to the group of curved rollers 98, 98*a* and 99. The curved rollers 98 and 98*a* serve to initially smoothen the material and can be forgone in some cases. It is most important that the counter-rolls 99 is in fact a curved roll.

Curved rolls, i.e. curved spreading rolls are known per se (see M. Peter, Grundlagen der Textilveredlung, 10. Edition, 1970, page 48) and are for example sold by the company Stove-Woodward Inc., (Mass., U.S.A.). They are shaped as a curved cylinder. Such curved rolls are preferred whose curvature can be adjusted by an axial pressure.

As it can be seen from FIG. 9, the curvature of the curved rolls 98, 98*a* and 99 is adjusted in such a direction R that the material web is spread and not compressed. The last (or sole) curved roll 99 is equipped with the above defined and explained characters of a counter-roll. Since the axis of the roll 99 is not at all points parallel to the axis of the applicator roll 1, the nip between the rolls 99 and 1 is not always precisely defined. But such a nip is obtained at least approximately and the necessary supported condition for the material web is fulfilled in practice in a sufficient manner when the roll 99 is stepwise approached to the roll 1 during the process, and furthermore the direction R is selected to be substantial parallel to the tangent of the roll 1 in the roll nip.

The device represented in FIG. 9 allows a uniform liquor application on material webs having very permanent creases which are however smoothened at the moment of the liquor application.

The device of this invention can for example be used to carry out the following finishing processes on textile material and paper; the composition of the liquors to be used is basically knew to the man skilled in the art.

Softening,
Hydrophobing,
Finishing to resist waterdrops,
Rotting resistance finishing,
Antisoiling,
Oleophobing,
Wrinkle resistant finishing,
Lustering (Chintz)
Flame resistant finishing,
Antistatic finishing,
Antifelting finishing,
Antimoth finishing,
Carbonizing,
Decating,
Effect finishing,
Permanent press finishing,
Crump resistent finishing,
Stiffening,
Dyeing, especially:
Pigment dyeing and
Reactive dyeing 2. Paper Dyeing, especially in light tones.
Flames resistant finishing,
Hydrophobing,
Oleophobing.

The invention will now further be illustrated by a process example which should not limit this invention

EXAMPLE 2

In the apparatus represented in FIG. 4, the fabric intended for light professional cloths, 115 cm wide, consisting of 65% of polyester and 35% of cotton, weight per unit area 105 g/m2, average thickness about 0.21 mm, is permanent press finished and simultaneously optical brightened.

An aqueous liquor of the following composition (in g/l) is used:

| | |
|---|---|
| FIXAPRET CPN (reactive resin)(BASF) | 120 |
| SILIGEN MA (tenside)(BASF) | 2 |
| LEOMIN NI (softener) | 50 |
| UVITEX EBF (optical brightener in dispersion) | 30 |
| INDANTHREN BRILLANTVIOLETT RKM (blueing agent) | 25[1] |
| INDANTHREN BLAU BC (blueing agent) | 1,6[1] |
| Magnesium chloride (catalyst) | 15 |
| | ca. 238 |

[1]aqueous dispersion 0.1%

The other properties, parameters and process conditions were the following:

Liquor temperature: 22° C.
Film forming test: note 4 to 5
Foam value: 320 (110, 105,105)
Web speed: 40 m/min
Liquor take-up: 35% by weight, based on dry fabric
Drying conditions: 130° C. during 40 sec.
Condensation and thermosolation: 170° C./30 sec.

The textile web is simultaneously wash and wear finished and optically brightened.

Comparative test 1

The applicator was first a simple applicator roll having a diameter of 300 mm (see German patent No. 21 14 517). The obtained finishing showed some specks in the region of the selvedges.

Comparative test 2

A counterbalanced tangential steel roll (see FIG. 1) of a diameter of 150 mm has been used in addition to the roll of test no. 1

The finished fabric was slightly streaked due to the uneven thickness of the selvedges and a corresponding swinging movement of the guide roll.

Process of the invention

The applicator roll is a steel roll having a diameter of 300 mm. The counter-roll (FIG. 2, FIG. 8) has a diameter of 200 mm and is made of soft rubber having a Shore hardness of 35A. The roll nip S is adjusted to 0.15 mm (70% of the average thickness of the fabric).

The obtained finishing effects are homogeneous and free from stains, thus uniform.

The described subjects of the invention may be varied or modified within the frame of the claims. For example, it will be possible to drive or to slow the individual guide or deflection rollers of the apparatus, as necessary. The rollers may have another form than the geometrical cylinder one. The rollers 38 may be perforated vacuum rollers for still better liquor distribution or for special purposes. Rollers and other guide members, measuring devices etc. may be added to the apparatus.

It is further preferred to insert calming or stabilizing insets or baffles (not shown) for the liquor into the treating liquor vat (see FIGS. 4,6 and 7)in order to get a most uniform wave free film on the applicator roll.

The material web may be steamed before and/or after the contact with the applicator roll or set under vacuum in order to enhance the liquor penetration by the driving off of air. Any other pretreatment or posttreatment, known to the one skilled in the art, may be executed on the material web.

The invention may further be used for the application of foamed liquors. This is an alternative method to the described liquid liquor application technic; liquid liquors must be free from foam, and foamed liquors must not contain randomly flowing liquid. However, should foam be applied, the apparatus must be equipped with a system for preparing and conveying semistable, foam, and still other constructive adaptions must be made.

Film forming test

The forming of the film is visually observed on a model applicator roll having a diameter of about 200 mm and a length of about 250 mm. The roll has a surface finish exactly identical to that of the roll in the industrial machine.

1. Cleaning

The applicator roll is rubbed with a cleaning liquor comprising a solution of 10 g of a non-ionic foaming tenside in 1 l of isopropanol, and is then rinsed until the draining water is foam free and fresh water poured on the roll does no longer form a film.

2. Measuring

The applicator roll is rotated with a circumferential speed of 10 m/min. in a vat containing the liquor to be tested. Its temperature is 22±2° C. or the actual application temperature. The film is visually observed on the rotating roll illustrated by a fluorescent lamp.

3. Evaluation

Only such test liquors pass the test which form a coherent film on the applicator roll. The results of the observations are attributed a rating number from 1 to 5 with a precision of 0.5 units:

| | |
|---|---|
| rating 1: | no film formation |
| rating 2: | film, interrupted by large film-free areas |
| rating 3: | film devoid of film-free areas |
| rating 4: | film with smears |
| rating 5: | uniform film. |

Foam formation test

The foam formation must be tested since wetting liquids passing the above described film forming test tend normally to produce foam. This tendency must not exceed a certain degree.

The foam production is tested by means of mechanical rotation of a close mixing cylinder.

1. Cleaning

A glass mix cylinder of 250 ml, 2 ml graduation, height without stopper: 250 mm, diameter: 40 mm, is rinsed with acetone and dried.

2. Test 100 ml of liquor are cautionously poured into the cylinder to avoid foam formation. The cylinder is closed with a polyethylene stopper, clamped into a support, rotated with a speed of 0.5 rotations/sec and stopped after 5 tours. At the moment of stopping, the height of the liquor (liquid) plus foam is read in ml. A second reading is made 15 sec later, and a third one after 30 sec.

3. Evaluation

The foam index is laid down in ml, as a sum of the three readings. Only such treating liquors fulfil the test whose foam index is lower than 350, the individual values having a decreasing tendency, i.e. the first value must be greater than the third one. The application temperature of the liquor is selected as the test temperature.

We claim:

1. A process of continuous and uniform application of controlled amounts of treating liquor to an advancing, liquid receptive material web, comprising the steps of passing said material web over a counter-roll having a resilient but non-skidding surface and then passing said web in supported web condition onto an applicator roll having a metallic cylinder surface which has been dipped in a vat of treating liquor and is carrying a uniform liquor film, and rotating said applicator roll and counter-roll in the same directions, and using control means to control the amount of treating liquor on said web, whereby said material web is supplied in a continuous and uniform manner with amounts of treating liquor not exceeding the liquid saturation of said web;

the treating liquor being a foam forming liquor, before using a particular treating liquor, testing the treating liquor for foam formation and rejecting the liquor if it does not satisfy the test, the testing of the treating liquor for foam formation comprising placing 100 units of volume of the treating liquor in a mixing container having a scale divided into 250 units of volume, rotating the container at a speed of 0.5 rotation per second for five rotations and then halting the rotation, upon halting the rotation, measuring the volume of treating liquor sample and foam in the container, then 15 seconds later, measuring the volume of treating liquor sample and foam in the container a second time, and 30 seconds after the first measurement, measuring the volume of treating liquor sample and foam in the container a third time; adding the three measured combined volume readings of treating liquor and foam, and comparing that added sum with a preset standard value of 350 units of volume to determine that the sum is below that preset standard value, and rejecting the treating liquor if the test is not met.

2. A process of continuous and uniform application of controlled amounts of treating liquor to an advancing, liquid receptive material web, comprising the steps of passing said material web over a counter-roll having a resilient but non-skidding surface and then passing said web in supported web condition onto an applicator roll having a metallic cylinder surface which has been dipped in a vat of treating liquor and is carrying a uniform liquor film, and rotating said applicator roll and counter-roll in the same directions, and using control means to control the amount of treating liquor on said web, whereby said material web is supplied in a continuous and uniform manner with amounts of treating liquor not exceeding the liquid saturation of said web;

the treating liquor being a foam forming liquor, before using a particular treating liquor, testing the treating liquor for foam formation and rejecting the liquor if it does not satisfy the test, the testing of the treating liquor for foam formation comprising placing quantity of the treating liquor in a mixing container, and the container having a volume greater than the volume of the liquor placed in the container, rotating the container for a first period of time and then halting the rotation, upon halting the rotation, measuring the volume of treating liquor and foam in the container, after a second period of time, measuring the volume of treating liquor and foam in the container a second time, and after a third period of time, measuring the volume of treating liquor and foam in the container a third time; adding the three measured values of the volume of treating liquor and foam and comparing that added sum with a preset standard value to determine that the sum is below the preset value, and rejecting the treating liquor if the test is not met.

3. The process of claim 2, wherein the testing of the treating liquor additionally comprises additionally determining that the second measured volume is less than the first volume and that the third measured volume is less than the second volume.

4. The process of claim 3, wherein the applicator roll is a steel roll and the uniform liquor film is applied to the steel roll as coherent film.

5. The process of claim 3, wherein the quantity of the treating liquor placed in the mixing container is 100 ml and the preset standard value is 350 ml.

6. The process of claim 5, wherein the container is rotated at a speed of 0.5 rotations per second and is halted after five rotations and the first measurement is made, then the second measurement is made 15 seconds later and the third measurement is made 30 seconds later.

7. The process of claim 6, wherein the container in which the treating liquor is placed is 250 ml in volume.

8. The process of claim 2 wherein the distance between applicator roll and counter-roll is adjusted as a function of the thickness of said material web and is maintained constant by control means.

9. The process of claim 8 wherein said material web and the applicator roll surface have different speeds, and the slowing down of the material web imposed by frictional forces is controlled by a variation of the distance between applicator roll and counter-roll.

10. The process of claim 8 wherein said material web is guided on said applicator roll with a contact angle corresponding to a contact time of the material on the roll in the range from 0.02 to 0.2 seconds.

11. The process of claim 10 wherein the slowing down power of the material web is adjusted by varying the contact angle of the material web on the applicator roll.

12. The process of claim 2 wherein the amount of treating liquor applied per unit area of said material web is controlled by adjusting the rotation speed of said applicator roll.

13. The process of claim 2 wherein the amount of treating liquor applied per unit area of said material web is controlled by adjusting the liquor temperature, said applicator roll being realized in the form of a hollow cylinder, or the liquor itself being cooled or heated.

14. The process of claim 2 where said material web is guided over said counter-roll with a contact angle of from 60°to 120°, typically about 100°.

15. The process of claim 2 wherein an already liquor containing but not yet saturated material web is impregnated with an amount of further treating liquor, said amount corresponding to a predetermined value per unit area or corresponding to the difference up to a predetermiend total of the weight per unit area.

* * * * *

UNITED STATES PATENT AND TRADEMARK OFFICE

CERTIFICATE OF CORRECTION

PATENT NO. : 4,672,705

DATED : June 16, 1987

INVENTOR(S) : Hans Bors et al.

It is certified that error appears in the above-identified patent and that said Letters Patent is hereby corrected as shown below:

Line [54], change the title to read:

--PROCESS FOR APPLYING CONTROLLED AMOUNTS OF LIQUORS TO A RECEPTIVE MATERIAL WEB--

Signed and Sealed this

Twenty-seventh Day of October, 1987

*Attest:*

DONALD J. QUIGG

*Attesting Officer*

*Commissioner of Patents and Trademarks*